United States Patent [19]

Costa

[11] 4,372,263

[45] Feb. 8, 1983

[54] APPARATUS FOR STARTING INTERNAL COMBUSTION ENGINES

[76] Inventor: Paul Costa, 3940 7th Ave. SW., Golden Gate, Fla. 33999

[21] Appl. No.: 249,147

[22] Filed: Mar. 30, 1981

[51] Int. Cl.[3] ..... F02N 11/12

[52] U.S. Cl. ..... 123/179 SE

[58] Field of Search ..... 123/179 SE, 185 R, 185 D, 123/185 P; 74/550

[56] References Cited

U.S. PATENT DOCUMENTS 2,932,292 4/1960 Trotter et al. ..... 123/179 SE 3,537,436 11/1970 Heisler ..... 123/185 P

*Primary Examiner*—Charles J. Myhre

*Assistant Examiner*—Andrew M. Dolinar

*Attorney, Agent, or Firm*—Merrill N. Johnson

[57] ABSTRACT

A hand held electric motor driven drill is coupled by novel means to an internal combustion engine to start the engine. The end of the engine shaft is threaded to receive an elongated nut having a pair of V-shaped slots in its upper end, each slot having one side parallel to the axis of the shaft and the other side at an angle of 60° to the first side. The chuck of the drill is fitted with a flat faced tool made from a conventional wood bit whose tip and cutting edges have been rounded off to provide a safe and secure coupling with the slots and hole in the end of the nut threaded onto the engine shaft. With the tool pressed into the slots in the nut, the drill motor is energized to rotate the tool. The flat faces of the tool bearing against the two sides of the slots parallel to the axis of the shaft force the shaft to turn at the speed of the drill until the engine is started. The engine then picks up speed and as its speed exceeds that of the drill, the tool will be forced out of engagement with the nut by sliding along the 60° sloped sides of the slots in the nut.

3 Claims, 4 Drawing Figures

APPARATUS FOR STARTING INTERNAL COMBUSTION ENGINES

BACKGROUND AND SUMMARY OF THE INVENTION

The use of a conventional electric hand drill to crank and start a small internal combustion engine has been proposed by a number of persons. See, for example, U.S. Pat. Nos. 2,816,535; 2,901,911; 2,932,292; 3,537,436; 3,596,647 and also 3,885,544.

But despite numerous proposals and an increasing number of small engines in use, very little, if any, apparatus for safely and conveniently coupling a drill to an engine has appeared on the market or otherwise been made available to the public.

I have invented apparatus for coupling an electric drill to the shaft of an internal combustion engine which is very inexpensive to manufacture, simple to install, and safe and reliable to use.

In addition to a hand held electric drill and the internal combustion engine to be started, my invention consists of a novel elongated nut to be screwed onto the shaft of the engine and a tool to be held in the chuck of the drill and then coupled with the nut.

The nut is preferably hexagonal in cross-section and axially bored and tapped so that the nut can be screwed onto the exposed threaded end of a shaft of the engine. One end of the nut is machined to form a pair of V-shaped slots, each slot having a first face or side parallel to the axis of the nut and the other side at an angle of about 60° to the first side. The apex of the V-shaped slot is preferably rounded.

The tool chucked into the electric drill is made from a conventional flat faced bit for boring holes in wood. The sharp tip and cutting edges of the bit are filed down and rounded off to make a safe and frictionless connection between the tool and the nut mounted on the engine shaft.

To crank and start the engine, the elongated hexagonal nut is screwed onto the exposed end of the engine shaft and the tool is chucked into the electric hand drill. The tool is then inserted into the two slots in the end of the nut with the tip of the tool protruding into the hole in the nut and thus preventing the tool from slipping sideways out of coupling engagement with the nut.

The tool is pressed firmly against the nut and then turned on. As the drill shaft and tool turn, the flat faces of the tool bearing against the two sides of the slots lying parallel to the axis of the nut force the nut and engine shaft to turn at the speed of the drill, thereby cranking the engine until it starts.

The engine will then pick up speed until its speed exceeds that of the drill. As this happens, the nut will begin to turn faster than the tool, and the tool will be forced out of engagement with the nut by sliding along the 60° sloped sides of the slots in the nut. This prevents any possible wrenching or violent movement of the hand held drill as it is removed from engagement with the rapidly turning engine.

DETAILED DESCRIPTION OF THE INVENTION

My invention may be used for cranking and starting the small internal combustion engines which are in wide use for powering such diverse machinery as electric generators, lawn mowers, paint sprayers, gardening tools and portable washing equipment. My apparatus is far less expensive to manufacture and much easier to install and use than other apparatus thus far proposed.

Figure 1:
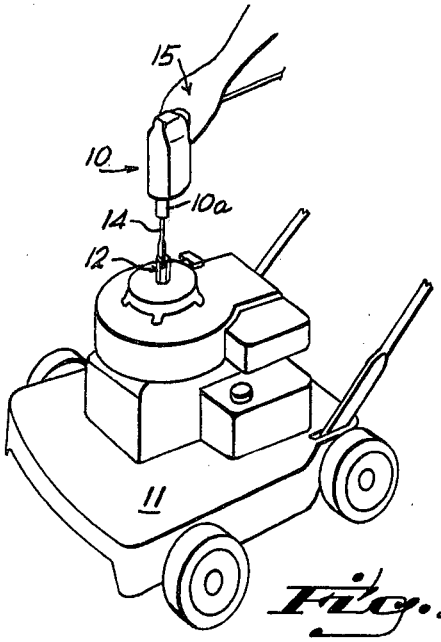
FIG. 1 is a perspective view showing a preferred embodiment of my invention for cranking and starting the internal combustion engine of a rotary lawn mower.

A preferred form of my invention is shown in FIG. 1 wherein a conventional hand held electric drill 10 is used to start the motor of a well known rotary lawn mower 11. The nut or other mechanism normally securing the upper end of the engine shaft has been removed and replaced by a novel elongated hexagonal nut 12 in accordance with my invention.

Figure 2:
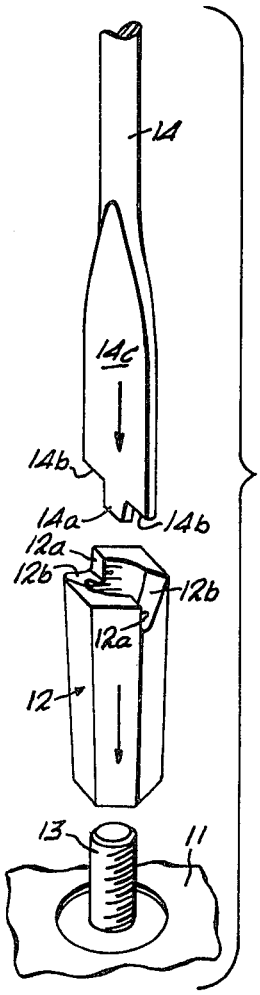
FIG. 2 is an exploded perspective view showing my elongated hexagonal nut to be threaded onto the engine shaft and the tool to be inserted into and coupled with the nut.
Figure 4:
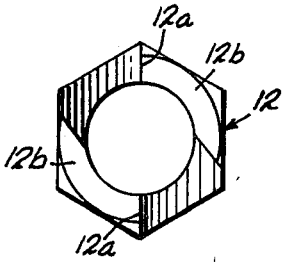
FIG. 4 is an elevational view looking down onto the upper end of my hexagonal nut showing the two slots machined in the end of the nut.

The novel features of nut 12 are perhaps best shown in FIGS. 2 and 4. The nut is preferably hexagonal as shown to permit ready installation with conventional hand tools. It is axially bored and tapped so that nut 12 can be easily screwed into the threaded end of engine shaft 13. The upper end of the nut is machined to form two identical V-shaped slots, each of the slots having a first face or side **12*a* lying parallel to the axis of the nut and a second face or side 12*b* at about a 60° angle to the first side. This second side 12*b* provides a smooth incline from the rounded apex of the slot up to the end of nut 12 as best shown in FIG. 2**.

In provide a safe and secure coupling between electric drill 10 and engine shaft 13, a tool 14 is used. Tool 14 is made from a conventional flat faced bit for boring holes in wood, preferably holes having a diameter of ¾ths of an inch thus making the width of the tool ¾ths of an inch. The sharp pointed tip of the bit has been ground off to form a projecting flange **14*a* preferably with the width of the flange at its base being about ⅜ths of an inch. Likewise, the sharp cutting edges of the bit have been rounded off to form two edges 14*b* shown in FIG. 2 which fit snugly into the rounded apex of the two slots in nut 12**.

Figure 3:
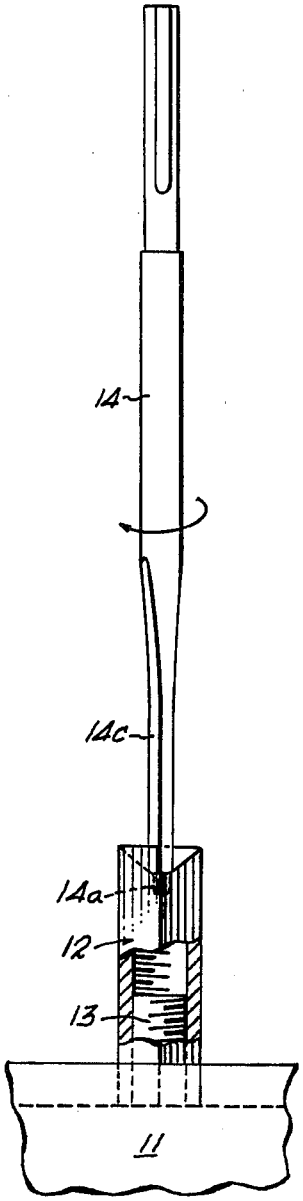
FIG. 3 is a side view partially broken away showing the nut threaded onto the engine shaft and the tool inserted into the slots in the nut.

When it is desired to start the engine of mower 11, nut 12 is screwed onto the threaded end of engine shaft 13 as shown in FIG. 3. Then tool 14 is secured into chuck **10*a* of electric drill 10 and, with the drill held in a hand 15 as shown in FIG. 1, the end of tool 14 is inserted into the slots and hole of nut 12. Flange 14*a* of the tool fits securely into the hole in nut 12 as best shown in FIG. 3, thus preventing tool 14 from slipping sideways out of engagement with nut 12**.

The two rounded edges **14*b* of the tool fit into the rounded apex of the two V-shaped slots in nut 12 and the flat faces 14*c* of the tool rest firmly against the two sides 10*a* of the nut. With the hand 15** holding the drill pressing the tool firmly downward, the drill is turned on.

With the drill motor on, tool 14 rotates as shown in FIG. 3, pressing tool faces **14*c* against sides 10*a* of the nut. This causes nut 12 and engine shaft 13** to turn at the speed of the drill, thus cranking the engine until it starts.

The engine normally runs at a much higher speed than that of drill 10. The engine will gradually increase from its starting speed until it exceeds the speed of the drill. As this occurs, nut 12 will begin to turn faster than tool 14, and the tool will gradually be forced out of engagement with the nut as tool edges **14*b* slide upward along the sloped sides 12*b* of the two slots in nut 12. This sliding action insures against any sudden wrenching or violent movement of the hand held drill as the drill is removed from its engagement with the engine of mower 11**.

Having disclosed a preferred embodiment of my invention, those skilled in the art will be able to modify certain aspects of my novel apparatus while still utilizing the principles of my invention and it is therefore intended that all such modifications be covered as they are embraced within the scope of the appended claims.

I claim:

1. Apparatus for coupling a hand held electric drill to a threaded upper end of an engine shaft of an internal combustion engine for cranking and starting the engine comprising:

an elongated nut which is axially threaded so that said nut can be screwed onto the threaded end of the engine shaft, said nut having two identical V-shaped slots in one end of the nut, the first side of each slot lying parallel to the axis of the nut, and the second side of the slot lying at an angle of substantially 60° to the first side with the apex of the V-shaped slot rounded to provide a smooth incline from the rounded apex to the end of the nut, and a tool made from a flat faced bit which can be coupled to be driven by said electric drill, said bit terminating in a flat sharp pointed tip and two sharp cutting edges at right angles to the axis of the bit for boring holes in wood, said tool being made by grinding off the tip of the bit to form a projecting flange and rounding off the cutting edges of the bit to form two edges which fit into the rounded apex of the two slots in the nut.

2. The apparatus set forth in claim 1 wherein the nut is hexagonal in cross-section.

3. The apparatus set forth in claim 1 or 2 wherein the tool has flat faces which have a width of $\frac{3}{4}$ths of an inch and the projecting flange has a width at its base of $\frac{3}{8}$ths of an inch.

* * * * *